US005388296A

United States Patent [19]

Mansour

[11] Patent Number: 5,388,296

[45] Date of Patent: Feb. 14, 1995

[54] FLUID PERMEABLE BED ACCESSORY

[76] Inventor: Joseph Mansour, P.O. Box 25033, Columbia, S.C. 29224

[21] Appl. No.: 5,121

[22] Filed: Jan. 15, 1993

[51] Int. Cl.[6] ..... A47G 9/00; A47C 27/00; A47C 27/14

[52] U.S. Cl. ..... 5/636; 5/638; 5/468; 5/484; 5/500

[58] Field of Search ..... 5/468, 484, 500, 502, 5/636, 638, 481, 464

[56] References Cited

U.S. PATENT DOCUMENTS

| | | | |
|---|---|---|---|
| 3,209,380 | 10/1965 | Watsky | 5/468 |
| 3,989,867 | 11/1976 | Sisson | 5/484 |
| 4,173,046 | 11/1979 | Gallagher | 5/484 |
| 4,216,774 | 8/1980 | Graber | 5/484 |
| 4,961,982 | 10/1990 | Taylor | 5/484 |

OTHER PUBLICATIONS

Study: Soft Bedding May Suffocate Babies; An Undated Article from an Unindentified Newspaper.

*Primary Examiner*—Alexander Grosz
*Attorney, Agent, or Firm*—George J. Rubens

[57] ABSTRACT

A novel bed accessory, such as a pillow, bed or crib sheet, is provided with a plurality of layers of foam rubber, elastomeric material or ther resilient material capable of creating air ventilation to the surface of the accessory, as well as transmitting and storing body secretions for subsequent removal, the layers having varying degrees of softness with the outer layers being softer than the inner layers to maximize comfort to the user.

11 Claims, 2 Drawing Sheets

FLUID PERMEABLE BED ACCESSORY

BACKGROUND

This invention relates to a bed accessory, and more particularly to a pillow or sheet, that will receive and store any body secretions in a sanitary manner; that will provide the user with ventilation; and that will offer maximum comfort to the user.

It is well known that many fatal accidents have occurred by suffocation because of lack of air, as well as from body secretions discharged and accumulated on pillows and sheets, especially to babies, small children, elders and invalids.

A sanitary bed pillow of this type is illustrated in U.S. Pat. No. 3,042,938 issued on Jul. 10, 1962 to R. W. Lawson. This patent discloses a pillow having a core member made of a single block of an impermeable material, such as polyethylene, rubber or other suitable material provided with interconnecting passages, spaced not more than 1/16" apart and not less than 1/16" in diameter, to receive body secretions. In another species of this patented invention, the single layer of material is formed of a network of impermeable filaments spaced in a criss-cross orientation with the passages formed in the spaces between the filaments. Still a third version of the invention consists of a single mass of fiber material.

It should be noted that each of the above patented constructions consist of a single mass of material having only one degree of compressibility. In addition, the size of the passages are inadequate to pass and store any particulate material that may be present in the body secretions, as well as making it difficult to clean the pillow. If the single layer of pillow material is made sufficiently hard to maintain the passages open under the weight of the occupant in order to function to ventilate as well as pass the secretions, it is likely to be too firm to be comfortable to user. On the other hand, if the pillow is made sufficiently soft to be comfortable to the user, the pressure of the occupant's body will most likely block the passages and defeat the function of the pillow.

BRIEF DESCRIPTION OF THE INVENTION

According to the present invention, a bed accessory, such as a pillow or bed sheet, comprises a plurality of layers of preferably impervious material, each layer having sufficiently large and well defined passages to pass and store any body secretions discharged on the pillow surface. The outer layer or layers closest to the body being softer than the inner layers to enable the bed accessory to be comfortable to the occupant when in use. The passages in the inner and outer layers have a sufficient diameter as to not be blocked under the weight of head or body of the user or by any particulate matter in the body secretions.

OBJECTS OF THE INVENTION

A principal object of this invention is to provide a bed accessory, such as a pillow or sheet, which is composed of a plurality of layers of different, relatively impermeable material having well defined passages capable of ventilating the accessory as well as transmitting and storing body fluids secreted by an user.

Another important object is to provide such a bed accessory having passages of a suitable size that will remain open open to perform their function under the weight of the user.

Still another important object is to provide a bed accessory having inner and other layers of such material in which one or more of the outer layers are less dense or softer than the inner layer so as to be more comfortable to the user.

DETAILED DESCRIPTION OF THE INVENTION

Figure 1:
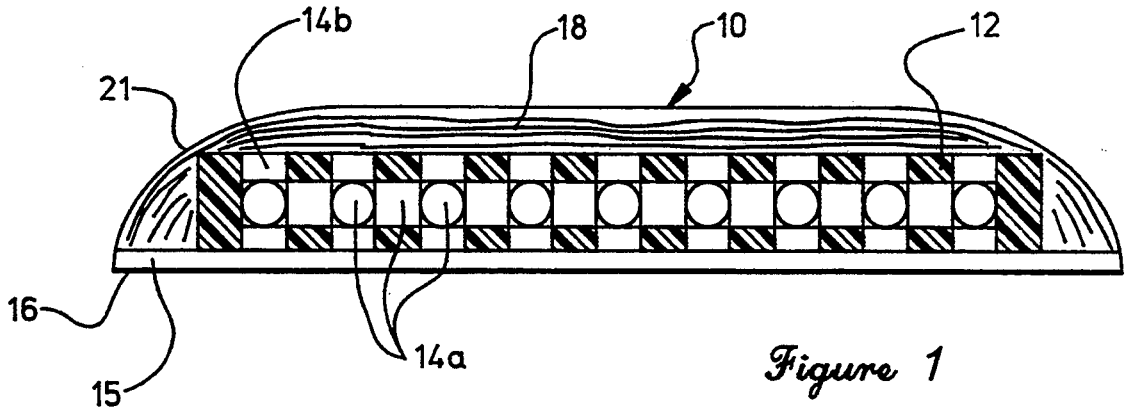
FIG. 1 is a vertical cross-section of the novel bed accessory used as a bed or crib sheet.
Figure 2:
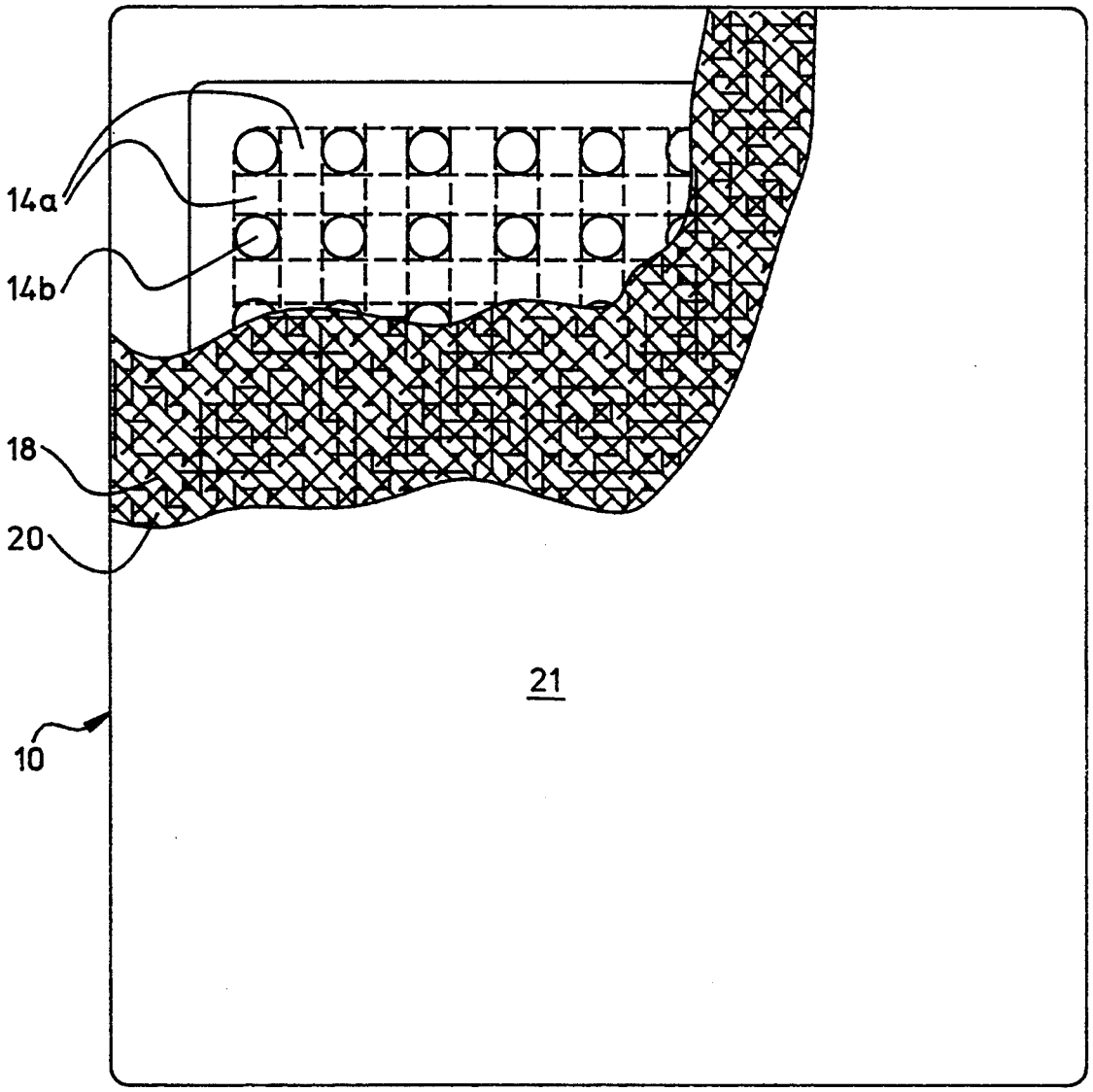
FIG. 2 is a top view of the bed accessory of FIG. 1 with one corner thereof partially a section showing the inner and outer layers, and the interconnecting passages in each layer.

Referring to the drawing where like reference numerals refer to similar parts throughout the figures, there is shown in FIGS. 1 and 2 the invention utilized as a bed or crib sheet 10. Sheet 10 comprises an inner layer or core member 12 made of a foam rubber or cellular elastomeric, relatively impermeable material so as to be liquid resistant and readily cleansed when contaminated. Core member 12 is constructed with a plurality of well defined interconnecting openings or passages 14 oriented in three axes, namely in a criss-cross orientation **14*a* in a horizontal plane aligned and connected to vertical passages 14*b*. Passages 14 can be molded, stamped, or otherwise formed in core member 12, as well as the other layers of materials to be described. The diameter of the passages is a significant feature of this invention so as to remain open to perform their described function under the weight of the occupant in the bed or crib, not shown. For example, if core member 12 is 2 inches in thickness, the diameter of passages 14 can be ¾ inches. Passages 14** allow for the circulation of air to the surface of the sheet, or pillow, as well as the passage of perspiration and other body secretions from the surface of the sheet or pillow to the core member for storage and subsequent removal.

The bottom of sheet 10 is provided with an absorbent layer 15, and a solid, non-absorbent layer 16 of any suitable material, and attached to the periphery of the sheet to prevent any see page from the core member into the supporting mattress, not illustrated.

An outer member 18 covers the upper and edge surfaces of core member 12 and is attached thereto to layer 16. Outer member 18 is composed of a plurality of superimposed layers of thin, non-absorbent, open netting material having openings 20 which are substantially vertically aligned to pass any fluid discharges on the surface of the sheet into passages 14 of core member 12 for storage and eventual removal.

Another significant feature of this invention is the fabrication the bed sheet 10, or a pillow, with inner and outer layers having different densities or degrees of softness. To acomplish this purpose, outer member 18 is constructed of a material that is softer than core member 12 so as to be more comfortable to the user while allowing the passages to remain open to perform their function under the weight of the user. Sheet 10 can be enclosed in a porous netting cover 21.

Figure 3:
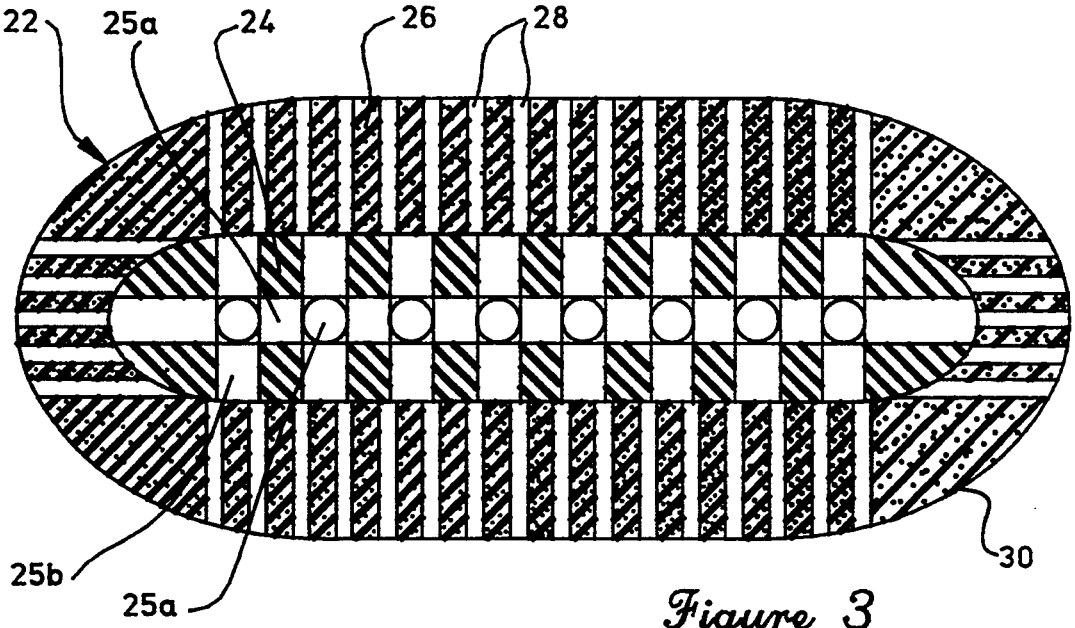
FIG. 3 is a vertical cross-section of the novel bed accessory used as a pillow having a single outer layer and a single inner or core layer, each layer having a different density or degree of compressibility.

In FIG. 3, the invention is illustrated in the form of a bed pillow 22 having a core member 24, similar in construction to core member 12 of FIGS. 1 and 2, having horizontally crossing passages 25*a* with intersecting vertical passages 25*b*. In FIG. 3, outer member 26 completely surrounds core member 24 and is made of a solid rubber or elastomeric material similar to core member 24, but is made of a softer composition to be more comfortable to the user. Outer member 26 has a plurality vertical passages 28, stamped or molded in the material, connecting to vertical passages 25*b* for passing bodily discharges from the surface of the pillow inwardly to core member 24 and distribution horizontally into passages 25*a* for storage. An outer pillow case 30 can be provided similar in construction to netting cover 21.

Figure 4:
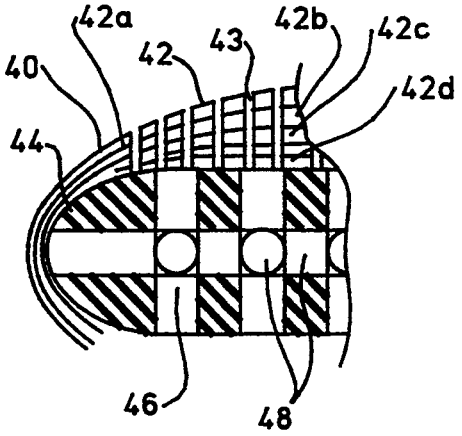
FIG. 4 is a vertical cross-section of another adaptation of the novel bed accessory, similar to FIG. 3, in which the pillow is provided with a plurality of outer layers having different densities, and a single core layer of a firmer material than the outer layers.

In FIG. 4 pillow 40 is similar to pillow 22 of FIG. 3 differing in the construction of outer member 42, with inner core member 44 being identical to inner core member 24 of FIG. 3. Outer member 42 is fabricated with a plurality of layers of rubber or elastomeric material, namely 42*a*, 42*b*, 42*c* and 42*d*, each layer having different degrees of softness, with outer layer 42*a* being softest and inner layer 42*d* being least soft and close in density to inner core member 44. Each of the layers 42*a* to 42*d* having vertically aligned passages 43 leading to vertical passages 46 and from there to horizontal passages 48 of inner core member 44.

Figure 5:
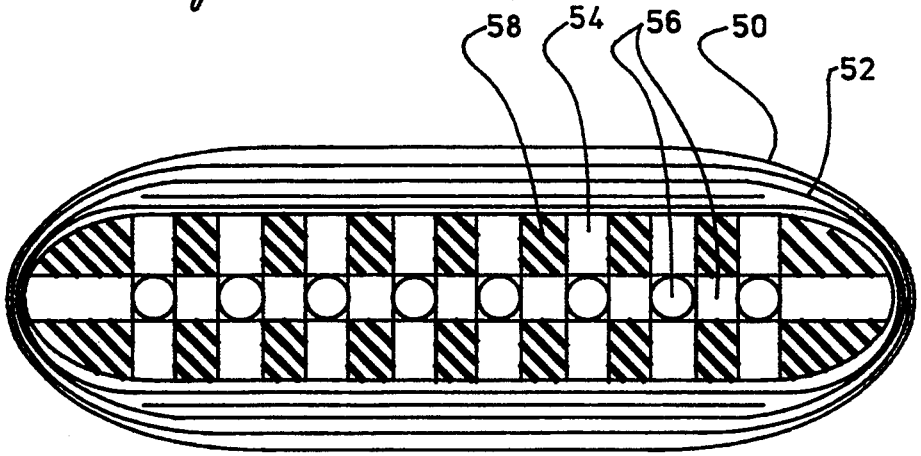
FIG. 5 is a vertical cross-section of still another species of the novel bed accessary similar to FIG. 4 in which the outer layer is fabricated of a plurality of thin sheets of an open netting material in superimposed relation.

In FIG. 5 pillow 50 is similar to pillow 40 of FIG. 4 differing in that layers 42*a* to 42*d* are replaced with a plurality of superimposed thin sheets 52 of netting material, similar to netting 18 of FIG. 1. Sheets 52 have aligned vertical openings that lead to vertical openings 54 and to horizontal openings 56 of inner core member 58.

The novel bed accessory of this invention can be configured as a pillow or bed sheet, particularly as a crib sheet. The bed accessory can be fabricated with a plurality of outer and inner members of relatively impermeable sponge rubber or elastomeric materials of varying densities that can be readily cleansed and reused.

The outer member or members are softer than the inner core member for more comfort to the user. All the outer members have co-extensive passages to enable any discharged body fluids to drain from the surface of the accessory inwardly to the core member for storage until cleansed. Accordingly, the novel bed accessory offers maximum ventilation as well as a means to remove bodily discharges from the surface, providing maximum safety from suffocation as well as maximum comfort to the user.

I claim:

1. A sanitary bed accessory 10 for use with a supporting mattress comprising at least one outer member 18 and an inner core member 12 made of a cellular material, each member made of a relatively non-absorbent material with the outer member being softer in composition than the inner core member, said inner core member having a plurality of well defined interconnecting passages 14*a* and 14*b* having a sufficient diameter to remain open under the weight of the body of the user, passages in the outer member draining any bodily fluids from the surface of the bed accessory into the passages of the inner core member for storage until cleansed.

2. The bed accessory of claim 1 being a pillow wherein the outer member surrounds the inner core member.

3. The bed accessory of claim 1 being a bed sheet, and the members 12 and 18 are in the form of flat layers with the inner core member 12 having a protective bottom sheet 16 for blocking any leakage of bodily fluids on to the supporting mattress.

4. The bed accessory of claim 1 wherein well defined passages of the outer member are vertically aligned with the passages of the inner core member.

5. The bed accessory of claim 1 wherein is provided a plurality of outer superimposed members.

6. The bed accessory of claim 5 wherein said outer members are made of thin sheets of open netting material 18.

7. The bed accessory of claim 5 wherein said outer members are made of solid layers having well defined vertical passages in aligned relation with the well defined passages in the inner core member.

8. The bed accessory of claim 7 wherein the outer layers have decreasing degrees of softness from the outermost layer inwardly to the inner core member.

9. The bed accessory of claim 1 being a bed sheet and the members are in the form of flat sheets, the outer member consisting of a plurality of superimposed layers of netting material; and an impermeable layer 16 defining its bottom, to thereby prevent passage of fluids from the inner core member 12 to the supporting mattress.

10. The accessory of claim 1 wherein the accessory is a sheet adapted to cover the mattress and the inner core member has well defined connecting passages of $\frac{3}{4}$ inch diameter extending along three axes with the sheet having an impermeable layer defining its bottom, to thereby prevent passage of the fluid from the inner core to the supporting mattress.

11. A sanitary bed accessory for use with a supporting mattress comprising a plurality of outer superimposed members 18 in the form of layers of thin sheets of open netting material, and an inner core member 12 made of cellular elastomeric material, said members made of a relatively non-absorbent material, said outer members being softer in composition than the inner core member to provide maximum comfort to the user, said inner and outer members having a plurality of vertically aligned passages capable of transmitting any bodily fluids discharged on the surface of the accessory into the inner core member for storage and subsequent removal, said inner core member having well defined connecting passages extending along three axes of a sufficient diameter to remain open under the weight of the body of the user.

* * * * *